US009079453B1

(12) United States Patent
Cox

(10) Patent No.: US 9,079,453 B1
(45) Date of Patent: Jul. 14, 2015

(54) CONTAINER HOLDER HAVING ROTATABLE CIRCULAR JOINT

(76) Inventor: Grant Cox, Woodacre, CA (US)

( * ) Notice: Subject to any disclaimer, the term of this patent is extended or adjusted under 35 U.S.C. 154(b) by 955 days.

(21) Appl. No.: 12/561,928

(22) Filed: Sep. 17, 2009

Related U.S. Application Data

(60) Provisional application No. 61/192,371, filed on Sep. 18, 2008.

(51) Int. Cl.

| | |
|---|---|
| ***B65D 25/20*** | (2006.01) |
| ***A47G 23/03*** | (2006.01) |
| ***B44D 3/14*** | (2006.01) |
| ***E04D 15/00*** | (2006.01) |

(52) U.S. Cl.
CPC . *B44D 3/14* (2013.01); *E04D 15/00* (2013.01)

(58) Field of Classification Search
CPC .... B44D 3/14; A61J 2001/2031; E04D 15/00
USPC ..... 220/23.83, 23.86, 503–506, 605, 623, 220/625–631, 636, 729, 733, 737, 738, 220/4.25–4.27; 222/570
See application file for complete search history.

(56) References Cited

U.S. PATENT DOCUMENTS

| | | | | | |
|---|---|---|---|---|---|
| 40,061 | A | * | 9/1863 | Pilbeam | 220/561 |
| 911,262 | A | * | 2/1909 | Perry | 220/631 |
| 938,658 | A | * | 11/1909 | Gerster | 210/244 |
| 1,058,818 | A | * | 4/1913 | Waldron et al. | 248/148 |
| 1,333,051 | A | * | 3/1920 | Young | 220/252 |
| 1,423,726 | A | * | 7/1922 | Mohr et al. | 248/148 |
| 1,498,367 | A | * | 6/1924 | Ferguson | 137/625.24 |
| 1,502,385 | A | * | 7/1924 | Hauenstein | 248/346.01 |
| 1,509,524 | A | * | 9/1924 | Morrison | 220/212 |
| 1,572,444 | A | * | 2/1926 | Mueller | 248/146 |
| 1,650,433 | A | * | 11/1927 | Dages | 248/148 |
| 1,655,911 | A | * | 1/1928 | Magid | 211/69.7 |
| 1,700,666 | A | * | 1/1929 | Bright | 38/102.2 |
| 2,048,695 | A | * | 7/1936 | Hasenour | 206/459.5 |
| 2,050,862 | A | * | 8/1936 | Sigl | 220/212 |
| 2,197,672 | A | * | 4/1940 | Winters | 222/490 |
| 2,659,920 | A | * | 11/1953 | Bogan et al. | 132/73.5 |
| 2,665,949 | A | * | 1/1954 | Ericson | 406/137 |
| 2,688,418 | A | * | 9/1954 | Carter | 220/4.03 |
| 2,748,952 | A | * | 6/1956 | Martin et al. | 211/74 |
| 2,779,313 | A | * | 1/1957 | Touney | 248/146 |
| 2,802,609 | A | * | 8/1957 | Donovan | 222/570 |
| 2,905,351 | A | * | 9/1959 | Lerner | 215/376 |
| 2,989,207 | A | * | 6/1961 | Clar et al. | 220/629 |
| 3,016,169 | A | * | 1/1962 | Kirshenbaum | 222/192 |

(Continued)

FOREIGN PATENT DOCUMENTS

DE 511444 C * 10/1930

*Primary Examiner* — Anthony Stashick
*Assistant Examiner* — Ned A Walker
(74) *Attorney, Agent, or Firm* — Westberg Law Offices

(57) ABSTRACT

A container holder includes a base section and a top section. The base section has a base bottom that is configured to rest on a surface. The base section also has a base top which terminates in a circular lip. An area defined by the circular lip is substantially angled with respect to the base bottom. The top section has an opening configured to receive a container and a circular rim for slidably engaging the circular lip of the base section such that the top section is rotatable with respect to base section. A rotatable circular joint is formed between the top section and the base section. The top section is tilted by an amount that changes as the rotatable circular joint is rotated.

19 Claims, 6 Drawing Sheets

(56) References Cited

U.S. PATENT DOCUMENTS

| | | | | | |
|---|---|---|---|---|---|
| 3,100,054 | A | * | 8/1963 | Rubens | 220/574 |
| 3,220,685 | A | * | 11/1965 | Himler | 248/133 |
| 3,252,635 | A | * | 5/1966 | Rosenhan | 222/527 |
| 3,272,395 | A | * | 9/1966 | Lawyer | 222/189.07 |
| D209,599 | S | * | 12/1967 | Craighead | D99/37 |
| 3,611,998 | A | * | 10/1971 | Loscalzo | 119/61.54 |
| 3,808,081 | A | * | 4/1974 | Okuhara et al. | 362/142 |
| 3,832,738 | A | * | 9/1974 | Kliemann | 4/144.1 |
| 3,899,107 | A | * | 8/1975 | Gaal | 222/570 |
| 3,927,782 | A | * | 12/1975 | Edwards | 215/372 |
| 3,964,709 | A | * | 6/1976 | LaBelle et al. | 248/133 |
| 4,001,444 | A | * | 1/1977 | Clarke | 426/110 |
| 4,098,439 | A | * | 7/1978 | Blow et al. | 222/531 |
| 4,494,585 | A | * | 1/1985 | Waldecker | 141/98 |
| 4,519,565 | A | * | 5/1985 | Whitmore | 248/237 |
| 4,597,550 | A | * | 7/1986 | Rice, Sr. | 248/146 |
| D286,508 | S | * | 11/1986 | Tilden | D9/435 |
| 4,715,510 | A | * | 12/1987 | van der Meulen et al. | 220/718 |
| 4,736,874 | A | * | 4/1988 | Durant | 222/570 |
| 4,765,501 | A | * | 8/1988 | Kao | 220/4.21 |
| 4,795,117 | A | * | 1/1989 | Siteman | 248/146 |
| 4,883,188 | A | * | 11/1989 | Barth | 215/12.1 |
| 4,907,714 | A | * | 3/1990 | Gatz | 222/570 |
| 5,004,072 | A | * | 4/1991 | Launer | 182/45 |
| 5,064,090 | A | * | 11/1991 | Farrier | 220/482 |
| 5,137,188 | A | * | 8/1992 | Thompson | 222/570 |
| 5,232,187 | A | * | 8/1993 | O'Farrell et al. | 248/148 |
| 5,295,598 | A | * | 3/1994 | Gerlach et al. | 215/376 |
| 5,316,248 | A | | 5/1994 | Allen | |
| 5,540,341 | A | * | 7/1996 | Holley et al. | 215/11.4 |
| 5,651,523 | A | * | 7/1997 | Bridges | 248/311.2 |
| 5,678,709 | A | * | 10/1997 | Holley et al. | 215/11.4 |
| 5,706,980 | A | * | 1/1998 | Dickerson | 222/129 |
| 5,813,638 | A | * | 9/1998 | Morris | 248/152 |
| D409,486 | S | * | 5/1999 | Goserud | D9/439 |
| 6,113,048 | A | * | 9/2000 | Shire | 248/309.1 |
| 6,126,048 | A | * | 10/2000 | Bublitz | 222/570 |
| 6,149,955 | A | * | 11/2000 | Wilson | 426/112 |
| 6,164,485 | A | * | 12/2000 | Hilton | 220/521 |
| 6,277,422 | B1 | * | 8/2001 | Gale | 426/115 |
| 6,321,932 | B1 | * | 11/2001 | Butters, III | 220/737 |
| 6,361,001 | B1 | | 3/2002 | Durand | |
| D460,358 | S | * | 7/2002 | Ciolino | D9/447 |
| 6,491,183 | B1 | * | 12/2002 | Huang | 220/629 |
| 6,503,014 | B2 | * | 1/2003 | Louis et al. | 401/126 |
| 6,533,227 | B1 | * | 3/2003 | Rom | 248/148 |
| 6,598,418 | B2 | * | 7/2003 | Holley, Jr. | 62/457.3 |
| D478,513 | S | * | 8/2003 | Canamasas Puigbo | D9/529 |
| 6,637,618 | B2 | * | 10/2003 | Friederich | 220/845 |
| 6,644,493 | B1 | * | 11/2003 | Walton et al. | 220/603 |
| 6,688,485 | B1 | * | 2/2004 | Lauer et al. | 220/574 |
| 6,779,915 | B2 | | 8/2004 | Foster, Jr. | |
| 6,920,991 | B2 | * | 7/2005 | Holley, Jr. | 215/6 |
| 6,978,898 | B2 | * | 12/2005 | Carlucci et al. | 206/581 |
| 6,983,869 | B1 | * | 1/2006 | Stevens | 222/570 |
| 7,111,748 | B2 | * | 9/2006 | Cha | 220/4.27 |
| 7,127,912 | B2 | * | 10/2006 | Holley, Jr. | 62/457.3 |
| D547,615 | S | * | 7/2007 | Wasserman et al. | D7/560 |
| D564,844 | S | * | 3/2008 | Schreiber-Pethan et al. | D7/586 |
| D568,688 | S | * | 5/2008 | Wasserman et al. | D7/586 |
| 7,984,821 | B1 | * | 7/2011 | Malmberg | 220/631 |
| 8,251,235 | B2 | * | 8/2012 | Py et al. | 215/11.4 |
| 8,763,835 | B2 | * | 7/2014 | Tirone et al. | 220/23.87 |
| 2002/0195456 | A1 | * | 12/2002 | Friederich | 220/845 |
| 2004/0134222 | A1 | * | 7/2004 | Holley, Jr. | 62/457.4 |
| 2004/0188371 | A1 | * | 9/2004 | Holley, Jr. | 215/11.1 |
| 2004/0262323 | A1 | * | 12/2004 | Cha | 220/709 |
| 2006/0226310 | A1 | * | 10/2006 | Hall et al. | 248/148 |

* cited by examiner

CONTAINER HOLDER HAVING ROTATABLE CIRCULAR JOINT

This application claims the benefit of U.S. Provisional Application No. 61/192,371, filed on Sep. 18, 2008, the entire contents of which are hereby incorporated by reference.

FIELD OF THE INVENTION

The present invention relates to container holders.

BACKGROUND OF THE INVENTION

Containers, such as buckets and similar containers, are commonly used in a variety of industries, including manufacturing, building construction, building maintenance and food service. Such containers are also used in households for storage and for cleaning and home repair activities.

Accessories have been developed which are intended to increase the usefulness of such containers. Examples include a tool holder for use in conjunction with a bucket, bucket pourers and bucket holders.

What is needed is an improved container holder.

SUMMARY OF THE INVENTION

The present invention is a container holder. In an embodiment, the container holder includes a base section and a top section. The base section has a base bottom that is configured to rest on a surface. The base section also has a base top which terminates in a circular rim. An area defined by the circular rim is substantially angled with respect to the base bottom. The top section has an opening configured to receive a container and a circular rim for slidably engaging the circular rim of the base section such that the top section is rotatable with respect to base section.

BRIEF DESCRIPTION OF THE DRAWINGS

The present invention is described with respect to particular exemplary embodiments thereof and reference is accordingly made to the drawings in which.

DETAILED DESCRIPTION OF THE INVENTION

Figure 1:
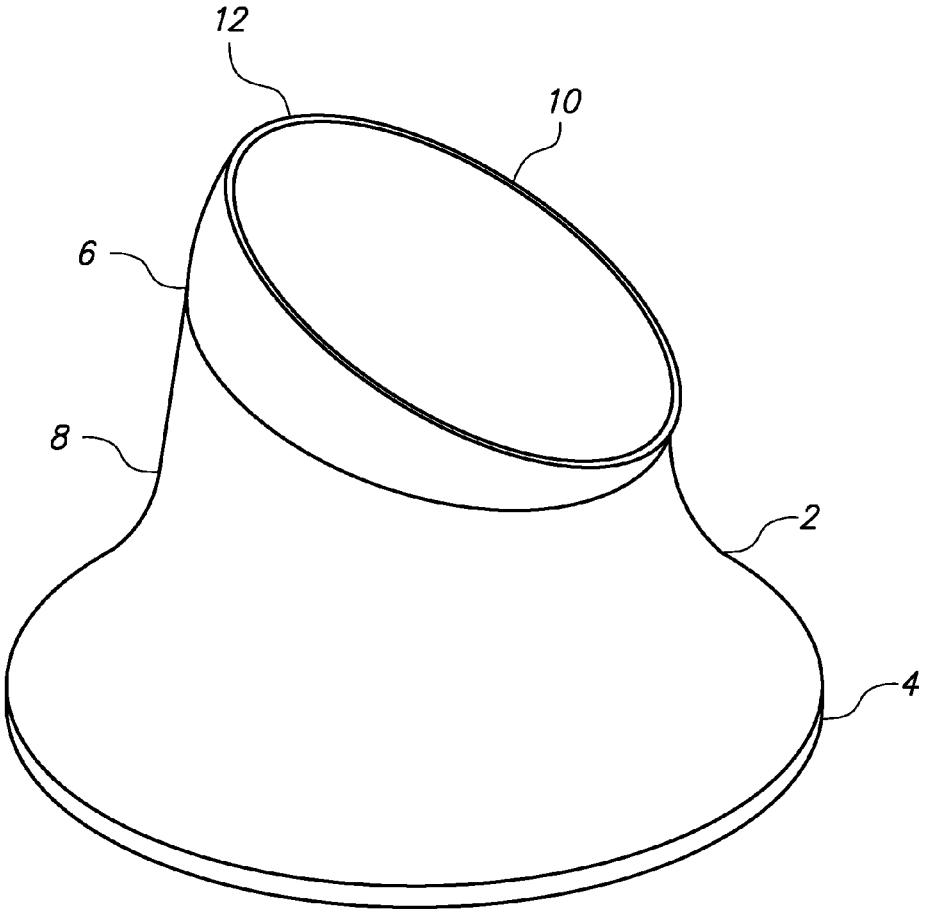
FIG. 1 illustrates a perspective view of a bottom section of a container holder in accordance with an embodiment of the present invention.

The present invention is a container holder having a base section and a pivotable top section attached to the base. The pivotable section is configured to receive a container, such as a generally-conforming five gallon bucket, and is attached to the base by a rotating joint which allows the pivotable section and the container to rotate with respect to the base. The rotating joint is preferably configured to cause the container to tilt by an amount that changes as the joint is rotated. The present invention can be used for a variety of tasks which involve the use of a container, such as construction work (e.g. for retaining materials used for tiling, painting, drywall taping, and so forth), gardening, janitorial and maintenance work, food storage, etc. The present invention can hold the container in an angled position in which the angle is selectable by rotating the pivotable section (and the container). The present invention also preferably provides increased stability for the container by providing that the base has a surface contact area that is wider than the container. The present invention also preferably holds the container at a position that is elevated from the ground which increases the accessibility of contents of the container.

The rotating joint between the base and the pivotable section preferably allows the pivotable section to be rotated 360 degrees independently from the base section. The joint between the two sections is preferably angled, so that as the top section rotates, its angle relative to the base section changes and therefore its angle with respect to a surface upon which the device is placed changes as well. The top pivotable section and base section are preferably separable and attached to each other. This can be accomplished using a locking nut and bolt assembly. Engaging the locking nut and bolt causes the top section to be attached to the base, but still rotatable with respect to the base.

When the container is inserted into the top section, it preferably remains in place by friction such that the inner diameter surface of the top section is in tight contact with the outer surface of the container. The container inserted into the top section can however preferably be easily removed by using hands. In an embodiment, the top lip of the container is exposed so that the container can be sealed with a lid while still engaged in the container holder. This allows the contents within the container to be sealed when not in use so as to not dry out or spoil.

In a preferred embodiment, the top section is itself configured as a material container, in which case, material, such as food, paint or adhesive, can be placed directly in the top section. In this embodiment, a container, such as a generally conforming five gallon bucket, can be placed in the top section if desired. Also, in this embodiment, an upper lip of the top section may be configured to receive a lid, such as a lid designed for a generally-conforming five-gallon bucket so that contents within the container can be sealed within the top section.

FIG. 1 is a perspective view of a bottom section of a container holder in accordance with an embodiment of the present invention. As shown in FIG. 1 a base 2 has a base bottom 4, a base top 6 and a sidewall 8 which extends upwardly from the bottom 4 to the top 6. In a preferred embodiment, the container holder 1 is configured to accommodate a generally-conforming five-gallon bucket, meaning that the container holder 1 is configured to accommodate live-gallon buckets which are commonly commercially available. The base 2 is preferably hollow with a circular cross section. The base bottom 4 preferably has a circular contact area when the container holder 1 is placed upon a flat surface. The circumference of the base bottom 2 is preferably larger than the base top 6 such that the sidewall 8 is flared outwardly from a smaller circumference at the top 6 to a larger circumference at the bottom 4. This larger bottom 2 provides for greater stability of the container holder 1. The height of the base 2 is approximately 10 to 14 inches from the base bottom 4 to the top 6, such that the highest point of the base top 6 is approximately 10 to 14 inches from the surface upon which the container holder 1 is placed.

The top portion 6 of the base 2 has a bowl-shaped bottom sidewall extension 10 that is cut at downward 25 to 45 degree angle with a circular rim 12 that runs the circumference of the bottom sidewall extension 10. The bottom sidewall extension 10 in conjunction with the circular rim 12 allows the top section to pivot and rotate as explained herein. Flaring the base 2 outward from top to bottom increases the stability of the device.

An embodiment of the present invention includes a flared base with an upwardly extending sidewall about 10 to 14 inches high that has a pivoting container attached to the top of the flared base where the pivoting container generally conforms to the size of a standard five gallon bucket. Another container, such as a bucket of substantially the same diameter as the pivoting container, may slide into the attached pivoting container. The pivoting container rotates around the top of the flared base; this rotation changes the angle of the pivoting container so that the pivoting container can be oriented by varying degrees, such as from vertical to a surface upon which the flared base is resting to horizontal with the surface. A user of the device is able to work with materials that are contained in either the pivoting container or in a bucket inserted into the pivoting container, where the materials are elevated by the height of the base and are able to be pivoted. The flared base allows for increased stability and traction for either the pivoting container or a bucket inserted into the pivoting container. The invention allows for the transporting of a filled container without the container sliding or tipping, or elevating a container, which increases the ergonomics of the container, therefore possibly avoiding back injuries or fatigue. The invention also allows for the container to angle and pivot, which enables the container to be placed safely on a pitched surface with the container oriented as desired. For example, the device may be used on a pitched roof while the container may be adjusted to a desired angle or even oriented level with respect to ground so as to avoid spillage of liquid contents. Alternatively, the device may be placed on a flat surface with the container tilted as desired to improve the access of the bucket contents, etc. For increased stability on pitched surfaces, a non-skid surface such as a rubber coating or one or more rubber feet may be provided at the bottom the base 2.

Figure 2:
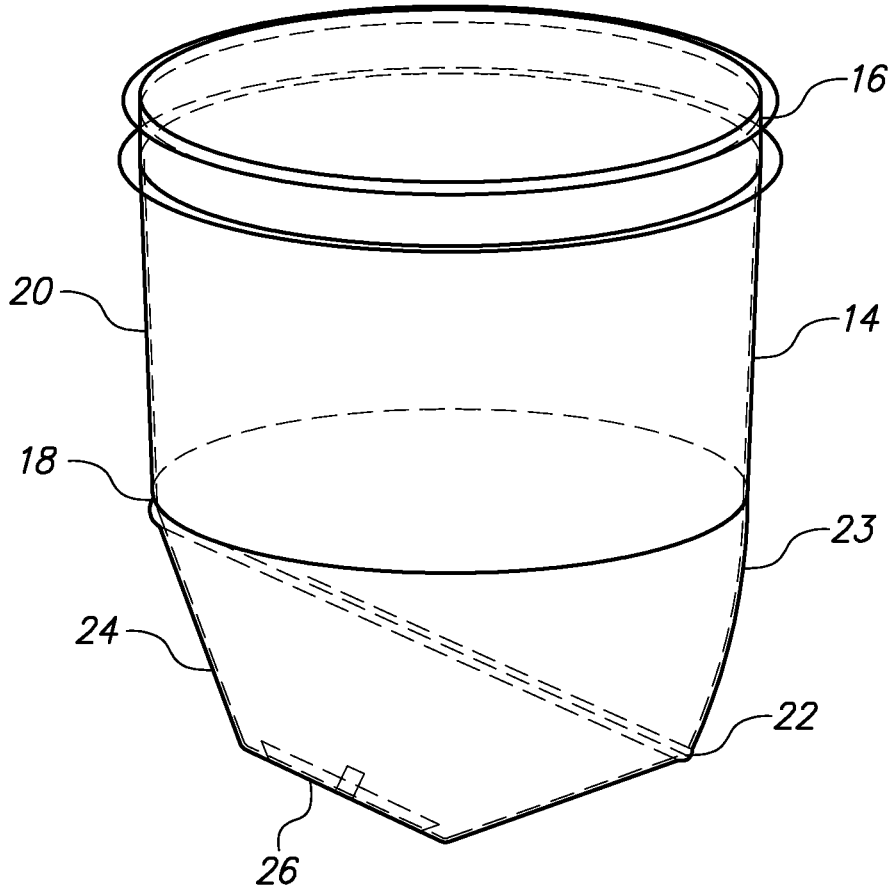
FIG. 2 illustrates a perspective view the top pivotable section of a container holder in accordance with an embodiment of the present invention.

FIG. 2 is a perspective view the top pivotable section 14 of the container holder in accordance with an embodiment of the present invention. This figure shows the top section of the device called the top 14. The top 14 is generally cylindrical and is preferably tapered such that the circumference at the top 16 of the top section 14 is larger than the bottom 18 of the top section 14. The overall inside circumference, between top 16 of the top section 14 and the bottom 18 of the top section 14 is similar to that of a generally conforming five gallon bucket, which will allow a generally conforming five gallon bucket to tightly slip into the top section 14. Thus, the bucket may be held on place by friction. In an embodiment, the device may be equipped with a fastening mechanism, such as a clasp and/or strap tensioner. In this case, the bucket can be fastened in place or inserted and removed from the device as desired.

The sidewall 20 of the top section 14 extends from the top 16 of the top section 14 to the bottom 18 of the top section 14. The bottom 18 of the top section 14 has a sidewall extension 23 that is cut at a downward 25 to 45 degree angle with a circular rim 22 that runs the circumference of the sidewall extension 23. From the circular rim 22 an interior angled flat-wall 24 extends inward to a flat bottom cap 26. The flat-wall section is preferably conical and thus rotatable. The flat bottom cap 26 in conjunction with the circular rim 22 allows for the top section 14 to pivot and rotate with respect to that base 2. The pivoting and rotation of the top section 14 greatly increases the ease of use of a generally conforming five gallon bucket and tends to reduce the typical bodily stresses experienced by a five gallon bucket user; this occurs through the improved positioning achieved through the invention.

Figure 3:
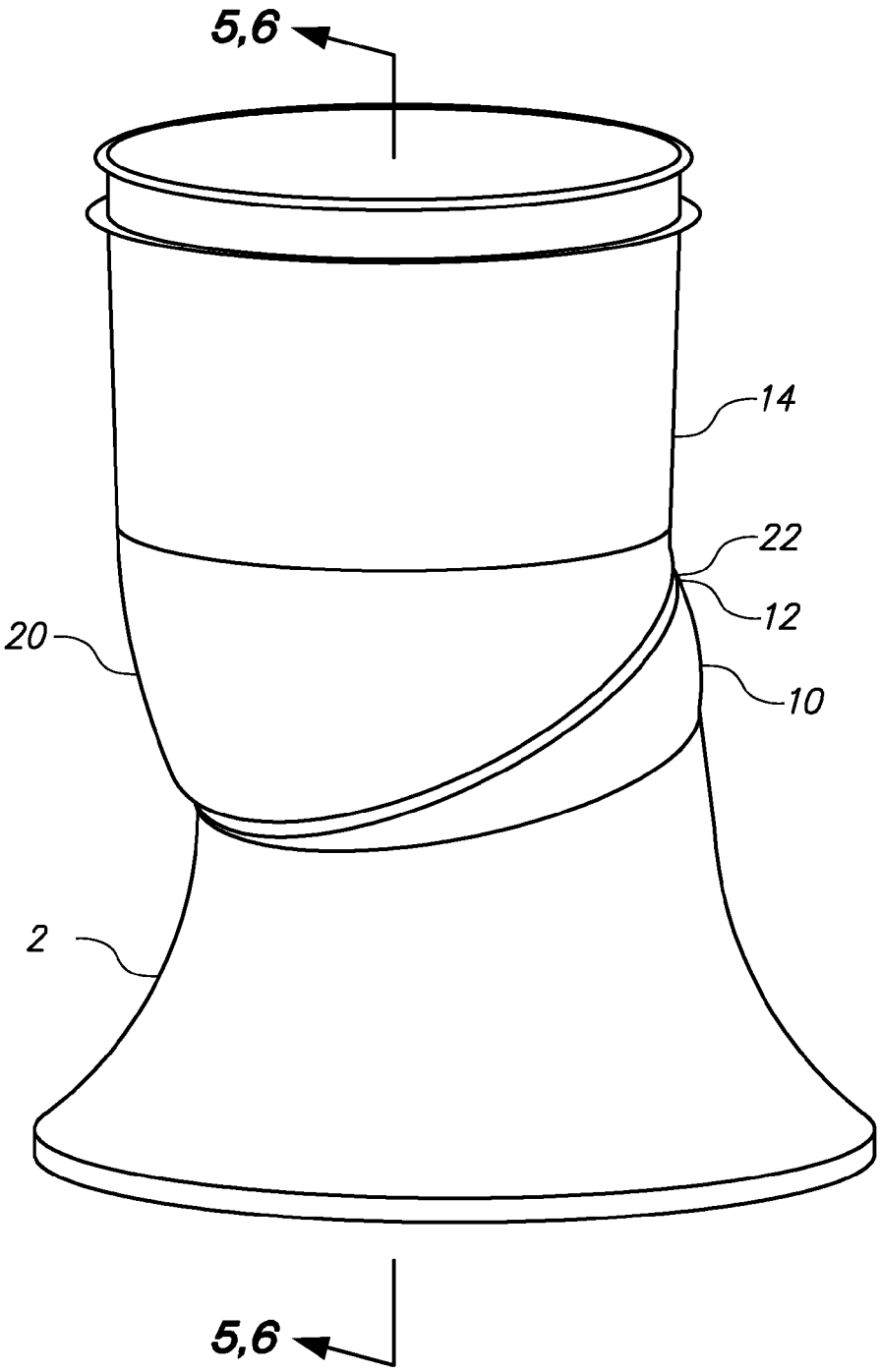
FIG. 3 illustrates a perspective view of a top pivotable section attached to a base section of a container holder in accordance with an embodiment of the present invention.

FIG. 3 is a perspective view of the top pivotable section 14 attached to a base section 2 of a container holder in accordance with an embodiment of the present invention. This figure shows the top section 14 with the circular rim 22 of the top section 14 attached to the circular rim 12 of the base section 2. This rotatable joint allows the top section 14 to freely rotate around the base 2 by the circular rim 12 fitting directly into the circular rim 22. The top 14, rotating around the base 2, allows the top 14 to pivot due to the 25 to 45 degree angle of the top sidewall extension 23 opposing and facing the 25 to 45 degree angle of the bottom sidewall extension 10. The top 14 attached to the base 2 demonstrates how the height of the container or a generally conforming five gallon bucket is increased; this increase in height allows the user to bend over less, which in turn, tends to decrease back strain and bodily stresses.

Figure 4:
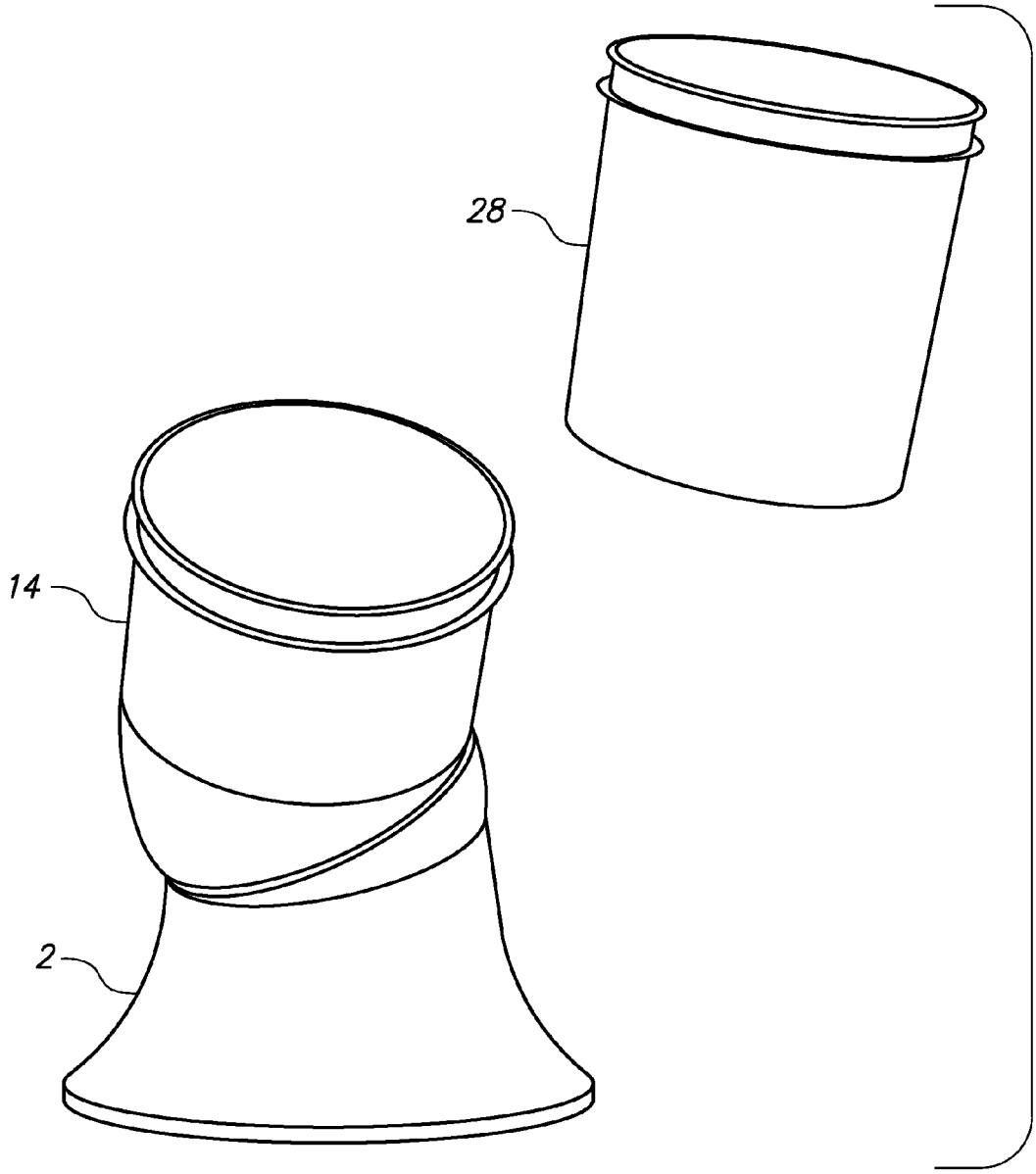
FIG. 4 illustrates a generally conforming five-gallon bucket along with a container holder in accordance with an embodiment of the present invention.

FIG. 4 illustrates a generally conforming five-gallon bucket along with a container holder in accordance with an embodiment of the present invention. The five gallon bucket and top section 14 are shown partially rotated and angled in relationship to the flared base bottom section 2. This figure shows the top section 14 rotated around the bottom section 2 which allows the top 14 to pivot by a range of angles, such as from a vertical position with the base 2 to a 90 degree angle to the base 2. A generally conforming five gallon bucket 28 will preferably tightly slip into the top section 14. The device can be used multiple times since a generally conforming five gallon bucket 28 can be inserted for use and removed after use with little or no wear and tear to the device.

Figure 5:
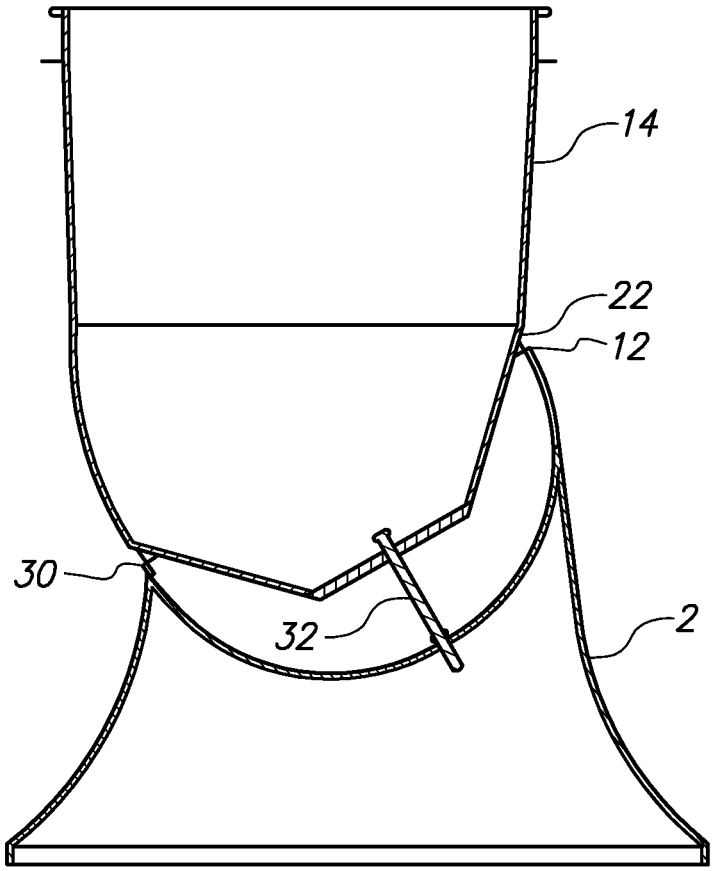
FIG. 5 illustrates a side sectional view of a container holder in accordance with an embodiment of the present invention.

FIG. 5 illustrates a side sectional view of a container holder in accordance with an embodiment of the present invention. The top section 14 is shown attached to the flared base bottom section 2. This figure also shows in the cross-sectional view an O-ring and locking bolt assembly 30 that can be used to attach the flared base bottom section 2 to the top section 14. This figure shows one of the many ways the top section 14 and the base 2 can be attached together, which is with an O-ring gasket 30 running between the circular rim 22 and the circular rim 12 and a standard locking bolt and nut assembly 32 running perpendicular to the rotatable joint between the base 2 and the top section 14.

Figure 6:
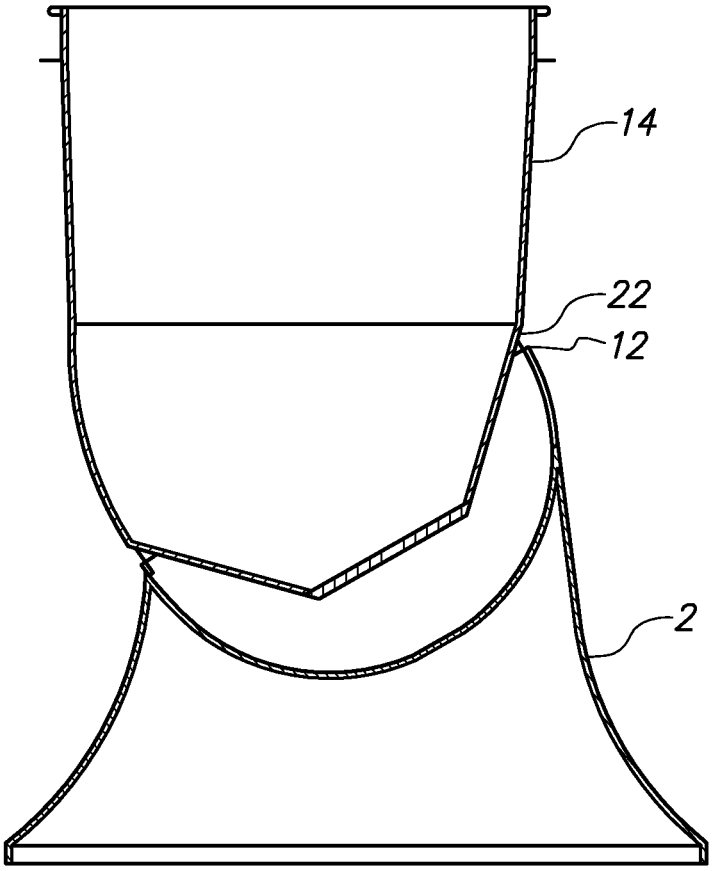
FIG. 6 illustrates a side sectional view of a container holder in accordance with an alternative embodiment of the present invention.

FIG. 6 illustrates a side sectional view of a container holder in accordance with an alternative embodiment of the present invention. FIG. 6 shows the top section 14 attached to the flared base bottom section 2. In this figure, the O-ring and locking bolt assembly are omitted. The figure shows one of the many ways the top section 14 and the base 2 can be attached together. For example, the top section 14 can be secured to the bottom section by a rotatable snap fit joint between the top section 14 and the base 2.

The foregoing detailed description of the present invention is provided for the purposes of illustration and is not intended to be exhaustive or to limit the invention to the embodiments disclosed. Accordingly, the scope of the present invention is defined by the appended claims.

What is claimed is:

1. A container holder comprising:

a unitary monolithic bottom section comprising:

an annular base having a first diameter and a transverse lower edge;

a flared circumferential sidewall;

a top surface extending inwardly from the sidewall;

a beveled top edge joining the sidewall and the top surface; and, a unitary monolithic top section comprising:

an open top having a second diameter less than the first diameter;

a cylindrical sidewall;

a bottom having an oblique annular bead;

an oblique joint formed between the beveled top edge and the oblique annular bead, the oblique joint allowing the top section to pivot and rotate with respect to the bottom section.

2. The container holder according to claim 1, wherein the bottom section is molded from a single first piece of plastic and the top section is molded from a single second piece of plastic.

3. The container holder according to claim 1, wherein the bottom section comprises a plurality of non-skid feet.

4. The container holder according to claim 1, the top section further comprising a bucket.

5. The container holder according to claim 1, wherein the oblique joint allows the top section to pivot between a vertical position and a 90° angle with respect to the bottom section.

6. The container holder according to claim 1, wherein the bottom of the top section is frustoconical.

7. The container holder according to claim 6, wherein the top section and the bottom section are secured together by a nut and bolt assembly extending through the bottom.

8. The container holder according to claim 1, wherein the top section is configured to receive a bucket.

9. The container holder according to claim 8 wherein the top section is configured to hold the bucket in place by friction.

10. The container holder according to claim 8, wherein the top section is configured to lock the bucket in place.

11. The container holder according to claim 8, wherein the bucket is a five-gallon bucket.

12. A container holder comprising:

a unitary monolithic base section comprising:

a planar base;

a beveled rim;

a flared circumferential sidewall extending upwardly from the planar base to the beveled rim;

a concave closed top surrounded by the beveled rim; and, a unitary monolithic top section comprising:

an open top configured to receive a bucket;

a cylindrical sidewall;

a frustoconical bottom having an angled circumferential bead seated upon the beveled rim, thereby allowing the top section to pivot up to 90° with respect to the base section; and, a fastener extending connecting the frustoconical bottom to the concave closed top.

13. The container holder according to claim 12, wherein the fastener is a nut and bolt assembly extending through the frustoconical bottom.

14. The container holder according to claim 12, wherein a first diameter of the planar base is greater than a second diameter of the open top.

15. The container holder according to claim 12, wherein the base section is molded from a single first piece of plastic and the top section is molded from a single second piece of plastic.

16. The container holder according to claim 12, wherein the base section comprises a plurality of non-skid feet.

17. The container holder according to claim 12, wherein the top section is configured to hold the bucket in place by friction.

18. The container holder according to claim 12, wherein the top section is configured to lock the bucket in place.

19. The container holder according to claim 12, wherein the bucket is a five-gallon bucket.

* * * * *